United States Patent [19]

Oenning et al.

[11] Patent Number: 4,988,386

[45] Date of Patent: Jan. 29, 1991

[54] COPPER-TUNGSTEN METAL MIXTURE AND PROCESS

[75] Inventors: James B. Oenning, Camarillo; Ian S. R. Clark, San Diego, both of Calif.

[73] Assignee: Fine Particles Technology Corporation, Auburn, Calif.

[21] Appl. No.: 212,861

[22] Filed: Jun. 29, 1988

[51] Int. Cl.[5] ..... B22F 1/00

[52] U.S. Cl. ..... 75/247; 419/23; 419/36; 419/47; 419/53; 419/37; 419/54; 75/248

[58] Field of Search ..... 75/247; 419/36, 34, 419/47, 53, 23

[56] References Cited

U.S. PATENT DOCUMENTS

| | | | |
|---|---|---|---|
| 3,438,753 | 4/1969 | Kenney et al. | 29/182.1 |
| 3,685,134 | 8/1972 | Blue | 29/420.5 |
| 4,299,889 | 11/1981 | Kato et al. | 428/569 |
| 4,430,124 | 2/1984 | Kato | 75/248 |

*Primary Examiner*—Stephen J. Lechert, Jr.
*Assistant Examiner*—Nina Bhat
*Attorney, Agent, or Firm*—Bruce A. Jagger

[57] ABSTRACT

A copper-tungsten mixture net-shaped product produced using powder metallurgical techniques with injection molding and liquid phase sintering. The product has a very low leak rate in helium gas, a high thermal conductivity and a rate of thermal expansion which is substantially the same as some glass and ceramic materials.

7 Claims, No Drawings

COPPER-TUNGSTEN METAL MIXTURE AND PROCESS

The present invention relates to metal admixtures and processes for making them. More particularly, the present invention relates to copper-tungsten admixtures having from approximately 5 to 50 weight percent copper made by an injection molding and liquid sintering process.

Previously, considerable difficulty had been experienced in producing satisfactory shapes from copper-tungsten admixtures. It is generally not possible to produce copper-tungsten tungsten mixtures in a liquid admixture. Previously, copper tungsten admixtures had been produced by powder metal press and sinter technology. The products produced by such procedures are generally of low density and low thermal conductivity because of residual porosity. The thermal conductivity may be increased somewhat and the porosity decreased somewhat by mechanically compressing these products, however, these procedure are not entirely satisfactory and are limited to uniaxially pressed parts.

In the high performance electronics area and particularly in military and space applications, it is customary to put microcircuit chips in hermetically sealed containers, which are known as "packages". These packages must of necessity have electrically insulated leads which extend through the walls of the package. The leads must be hermetically sealed and electrically insulated. The electronic packages generally are designed to contain heat generating components, so it is highly desirable to have the package constructed of materials which have a high thermal conductivity.

The packages must be hermetically sealed in order to protect the electrical components which are contained therein. Because these packages travel from sea level to the vacuum of outer space and back in a matter of minutes, any gas leakage is intolerable.

In general, the materials used to seal the openings through which the electrical leads pass are inelastic and have coefficients of thermal expansion which are substantially different from those of most metallic materials. Thus, thermal cycling causes stress in the seal and contributes to its rapid failure.

These and other difficulties of the prior art have been overcome according to the present invention, which provides a composition of matter comprising a high density copper-tungsten admixture which has a high thermal conductivity and a rate of thermal expansion which can be matched to that of many inelastic insulation-seal materials such as glass and ceramics. The high density copper-tungsten admixture is very impervious to gas.

The copper-tungsten composition is produced according to the present invention by a powder metallurgical process which involves injection molding to form complex shapes and uses a liquid-phase sintering step to densify the part. Such molding processes have in general been proposed before; see for example, Wiech, U.S. Pat. Nos. 4,374,457, 4,305,756 and 4,445,956. Reference is invited to these prior Wiech patents for the disclosure of such procedures.

Powder metallurgical procedures which involve injection molding and liquid phase sintering have the capability of producing net-shaped parts in very complex configurations to very close tolerances. Net-shaped parts are those parts or products which do not require any further machining, shaping or forming beyond the liquid sintering phase to be useful for their intended purposes. The tolerances which can be achieved are less than $+/-0.003$ inches per inch. Since the product is injection molded, the shapes of the parts can be extremely complex.

In general, a hermetically sealed electronic package is defined as having a helium gas leak rate of no greater than $1 \times 10^{-9}$ cm$^3$ of helium per second. The cooper-tungsten admixture products of this invention generally exhibit leak rates as low as approximately $2 \times 10^{-10}$ cm$^3$ of helium per second. Thus, the "hermeticity" of electronic packages constructed from this material is substantially in excess of that which is required.

The thermal conductivity of the copper-tungsten admixture according to the present invention is generally better than approximately 0.40 and preferably at least 0.42 calorie cm/cm$^2$ secs. degrees centigrade measured at a temperature of approximately 390 degrees centigrade. This thermal conductivity is measured for a material which contains about 5 weight percent copper. When less than 5 weight percent copper is present, the benefits of the present invention are generally not fully realized. At 25 weight percent copper, the thermal conductivity is generally more than approximately 0.60 and preferably at least about 0.65 calorie cm/cm$^2$ secs. degrees centigrade measured at a temperature of approximately 390 degrees centigrade. For a material which contains about 35 weight percent copper, the thermal conductivity is generally more than approximately 0.75 and preferably at least about 0.80 calorie cm/cm$^2$ secs. degrees centigrade measured at a temperature of approximately 390 degrees centigrade. At concentrations of copper greater than about 50 weight percent, the full benefits of the present invention are generally not realized.

The linear coefficient of thermal expansion is generally directly proportional to the volume percent of copper in tungsten. A value of about 7.0 parts per million/degree centigrade corresponds to 11 weight percent copper and 9.4 parts per million/degree centigrade corresponds to about 25 weight percent copper.

The linear coefficient of thermal expansion of the copper-tungsten material according to the present invention can generally be matched to that of the insulator-seal material in the electronic package by adjusting the percentage of copper in the admixture.

The thermal performance of the copper-tungsten material products of the present invention, particularly when considered in light of the hermeticity and the production of these materials in net-shaped configurations very significantly advances the art. The provision of a net-shaped product eliminates many of the previous requirements for machining and assembling electronic packages. Since the assembling of electronic packages according to previous teachings often involved brazing and soldering steps which permitted the opportunity for gas leaks, the elimination of improves the reliability of electronic packages. The use of the present invention makes it possible to increase the power density of the package while maintaining the same or improved reliability.

It is possible to manufacture the electrical leads which conduct electrical current into and out of the electronic package from the same copper-tungsten material according to the present invention. The thermal performance of the leads may thus be matched to that of the case. Since the high density copper-tungsten material is a good electrical conductor, the electrical efficiency of the package is also excellent.

The copper and the tungsten raw materials for use according to the present invention are provided in very finely divided form and in a highly pure state. In general, the particle sizes of the copper material are less than about 20 microns and the average particle size of the tungsten powder is less than about 40 microns. In general, the average particle size for these materials is below about ten microns. The amount of surface oxygen on the particles has a substantial impact on the nature of the finished product. At surface oxygen concentrations of more than approximately 5,000 parts per million on the copper, the results are very erratic surface oxygen concentration on the tungsten particles should be less than about 1,500 parts per million. In general, the particles are substantially equiaxed in shape. The impurities in the raw materials should be kept to an absolute minimum. As little as 2 percent of nickel, for example, will reduce the thermal conductivity by as much as 30 to 40 percent. As little as 0.3 of one percent of various impurities, such as, for example, oxides and trace amounts of lead and tin, may reduce the thermal conductivity by as much as 15 to 20 percent.

EXAMPLES

The following specific examples are provided for the purposes of illustration only and not limitation.

In a preferred embodiment of this invention a high purity copper-tungsten material was prepared with 35 weight percent copper and 65 weight percent tungsten. The tungsten powder had an average particle size between 1 and 2 microns, surface oxygen of less than about 1,400 parts per million and other impurities of approximately 300 parts per million. Copper powder having an average particle size of between 8 and 10 microns, surface oxygen of less than 800 parts per million, determined by hydrogen weight loss, and other impurities less than 500 parts per million was used. Both the tungsten and copper powder particles were substantially equiaxed. A binder consisting of 39.47 weight percent polypropylene, 9.74 weight percent carnuba wax, 48.73 weight percent paraffin wax and 2 06 weight percent stearic acid was prepared. The binder was admixed in the proportion of 4.3 weight percent with the above copper-tungsten powders. The admixing was accomplished under a vacuum so as to encourage the binder to wet the particulate surface and eliminate entrapped air, thus reducing the porosity and improving the thermal properties of the final product.

The resulting admixture of binder and metal powders was injection molded to produce a product having the desired shape. The product, called a green part, was heated in air to a temperature of about 207 degrees centigrade for a period of two days to remove the wax. The resultant intermediate product was then heated in an atmosphere containing 25 percent by volume hydrogen and 75 percent by volume of nitrogen at temperatures up to about 800 degrees centigrade until the polypropylene was removed. The temperature was then raised to about 1,235 degrees centigrade and held there for about three hours in an atmosphere containing 75 percent by volume hydrogen and 25 percent by volume nitrogen. The resultant sintered net-shaped product was allowed to cool for approximately six hours to room temperature. The physical properties of interest were determined to be as follows:

| THERMAL CONDUCTIVITY | LINEAR THERMAL COEFFICIENT OF EXPANSION | DENSITY |
|---|---|---|
| (Calorie-cm/cm$^2$ sec. degrees centrigrade) | (ppm/degree centigrade) | (g/cc) |
| 0.864 at 397 degrees centigrade<br>0.689 at 268 degrees centigrade<br>0.537 at 89 degrees centigrade | 10.4 at 41 to 263 degrees centigrade | 12.9 (97% of full density) |

ppm = parts per million

The hermeticity of these shaped products exhibits a leak rate of about $2\times10^{-10}$ cm$^3$ of helium per second.

Repeating this first example at 5 and 50 weight percent of copper, respectively, will provide products having the following properties:

(a) At 5 wt % copper the thermal conductivity is 0.45 calorie-cm/cm$^2$ sec. degrees centigrade measured at about 390 degrees centigrade, and the linear coefficient of thermal expansion is 5.6 parts per million per degree centigrade for 41 to 263 degrees centigrade; and (b) At 50 wt % copper the thermal conductivity is 0.87 calorie-cm/cm$^2$ sec. degrees centigrade measured at about 390 degrees centigrade, and the linear coefficient of thermal expansion is 11.7 parts per million per degree centigrade for 41 to 263 degrees centigrade.

In a second example of the preferred embodiment, the copper content was reduced to 15 weight percent and the tungsten increased to 85 weight percent. The same type of powders described in the first example were again used. The mixing, injection molding, and debinding procedures were again the same. However, the sintering temperature was increased to 1,450 degree centigrade. The physical properties of interest were determined. The linear thermal coefficient of expansion was 7.56 parts per million per degree centigrade and the density was 15.3 grams per cubic centimeter. The density is 94 percent of full theoretical density.

Repeating this second example will produce a product which has a thermal conductivity of about 0.57 calorie-cm/cm$^2$ sec. degrees centigrade measured at approximately 390 degrees centigrade.

In a third example, a high purity copper-tungsten material was prepared which had 25 weight percent copper and 75 weight percent tungsten. The tungsten powder which was utilized had an average particle size of between 1 and 2 microns, surface oxygen of less than about 1,400 parts per million and other impurities of approximately 300 parts per million. Copper powder having an average particle size of between about 8 to 10 microns, a purity of about 99.95 percent copper, surface oxygen of less than 800 parts per million determined by hydrogen weight loss and other impurities of less than 500 parts per million was utilized. Both the tungsten and copper particles were substantially equiaxed. A binder consisting of 39.47 weight percent polypropylene, 9.74 weight percent carnuba wax, 48.73 weight percent paraffin was and 2.06 weight percent stearic acid was prepared. The tungsten and copper powders were proportioned so that 25 weight percent copper and 75 weight percent tungsten were utilized. The metallic powder was admixed with the binder in proportions such that 4.3 weight percent of the resulting admixture was binder material. The admixing was accomplished under a vacuum so as to encourage the binder to wet the particulate surface and eliminate entrained air, thus reducing the porosity and improving the thermal properties of the final product. The resulting admixture of binder and metal powders was injection molded to produce a product having the desired shape. The product, called a green part, was heated in air to a temperature of about 207 degrees centigrade for a period of two days to remove the wax. The resultant intermediate product was then heated in an atmosphere containing 25 percent by volume hydrogen and 75 percent by volume of nitrogen at temperatures up to about 500 degrees centigrade until the polypropylene was removed. The temperature was then raised to about 1235 degrees centigrade and held there for approximately three hours. The resultant sintered net-shaped product was allowed to cool for approximately six hours. The thermal conductivity was determined to be 0.496 calorie-cm/cm$^2$ degrees centigrade at about 390 degrees centigrade.

Repetition of this experiment using a copper powder having a purity of 99.7 percent, containing about 0.24 weight percent of insoluble oxides and trace amounts of lead, silicon, calcium, magnesium and tin produced a product having a thermal conductivity of 0.401 calorie cm/cm$^2$ sec. degrees centigrade at about 390 degrees centigrade. Repeating these experiments utilizing particle size distributions which maximize compaction improves the thermal conductivity to more than about 0.42 calorie-cm/cm$^2$ sec degrees centigrade.

Repeating this experiment with the same copper material having a purity of 99.7 percent and including 2 percent weight of nickel produced a product having a thermal conductivity of only 0.293 calorie cm/cm$^2$ sec degrees centigrade.

What has been described are preferred embodiments in which modifications and improvements may be made without departing from the spirit and scope of the accompanying claims.

What is claimed is:

1. A composition of matter formed by the metal injection molding process comprising:

a copper-tungsten material comprising from approximately 5 to 50 percent by weight of copper, exhibiting hermeticity with a leak rate of less than about $1\times10^{-9}$ cm$^3$ of helium/sec., a thermal conductivity in the range of from more than about 0.40 at about 5 weight percent copper, to more than about 0.68 calorie-cm/cm$^2$ sec. degrees centigrade at about 50 weight percent copper, and a rate of thermal expansion in the range of from about 5.5 parts per million/degree centigrade at about 5 weight percent copper, to about 11.7 parts per million/degree centigrade at about 50 weight percent copper.

2. A composition of claim 1 wherein the material consists essentially of copper and tungsten.

3. A composition of claim 1 wherein the material has a leak rate at least as low as about $2\times10^{-10}$ cm$^3$ of helium per sec.

4. A composition of claim 1 wherein the composition is in a net-shape form of a hermetic enclosure.

5. A composition of matter of claim 1 wherein the composition is in a net-shape form of an electronic package having a thermal conductivity in the range of from more than about 0.42 at about 5 weight percent copper, more than about 0.60 at about 25 weight percent copper, to more than about 0.70 calorie-cm/cm$^2$ sec. degrees centigrade at about 50 weight percent copper.

6. A powder metallurgy injection molding process using liquid phase sintering to form net-shape products comprising:

selecting a copper powder having an average particle size of less than about 20 microns, less than about 5,000 parts per million surface oxygen, and less than about 500 parts per million of other impurities;

selecting a tungsten powder having an average particle size of less than about 40 microns, less than about 1,500 parts per million of surface oxygen, and less than about 300 parts per million of other impurities;

admixing said tungsten and copper powders under vacuum with a binder material to form an admixture;

injection molding said admixture to form a predetermined green shape;

debinderizing said green shape; and sintering said green shape to produce a net-shape product.

7. The powder metallurgy injection molding process of claim 6, including selecting a tungsten powder having a particle size distribution so as to maximize the compaction of said admixtures.

* * * * *